US005592709A

United States Patent [19]

Watkins

[11] Patent Number: 5,592,709

[45] Date of Patent: Jan. 14, 1997

[54] APPARATUS FOR ADJUSTING THE ATTITUDE OF A MATTRESS

[76] Inventor: John A. Watkins, deceased, late of Clarksville, Va., by Margaret C. Watkins, Administrator, P.O. Box 1426, Virginia Ave., Va. 23927,

[21] Appl. No.: 519,611

[22] Filed: Aug. 25, 1995

[51] Int. Cl.[6] ..... A47C 31/00

[52] U.S. Cl. ..... 5/660; 5/659; 5/509.1

[58] Field of Search ..... 5/509.1, 659, 660, 5/636, 643; 248/371, 393, 455

[56] References Cited

U.S. PATENT DOCUMENTS

| | | | |
|---|---|---|---|
| Re. 26,411 | 6/1968 | Alsobrook, Jr. . | |
| 1,599,000 | 9/1926 | Acuff . | |
| 1,967,771 | 7/1934 | Gardeski | 5/659 |
| 3,258,790 | 7/1966 | Maru | 5/643 |
| 3,259,921 | 7/1966 | Alsobrook, Jr. | 5/660 |
| 3,952,346 | 4/1976 | Carlson . | |
| 4,181,989 | 1/1980 | Bradley et al. | 5/509.1 |
| 4,561,549 | 12/1985 | Yokohori | 5/659 |
| 4,856,129 | 8/1989 | Butler | 5/509.1 |
| 5,205,005 | 4/1993 | Merrill et al. . | |
| 5,243,726 | 9/1993 | Bisbee . | |
| 5,936,674 | 3/1995 | Bolds | 5/643 |

*Primary Examiner*—Steven N. Meyers
*Assistant Examiner*—Tuyet-Phuong Pham
*Attorney, Agent, or Firm*—Dickinson, Wright, Moon, Van Dusen & Freeman

[57] ABSTRACT

An apparatus for adjusting the attitude of a mattress includes base elements for engaging the ledge of the side rails of a bed frame. A support bar extends between the base elements for supporting a box spring. The attitude of the mattress may be adjusted by moving the apparatus along the side rails.

4 Claims, 1 Drawing Sheet

FIG. 1
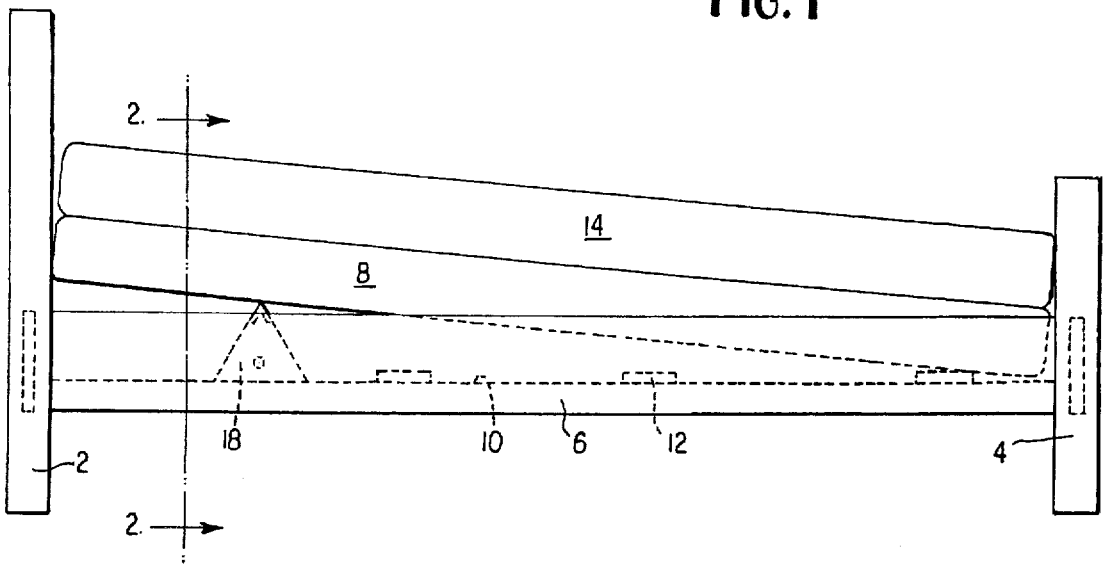
FIG. 2
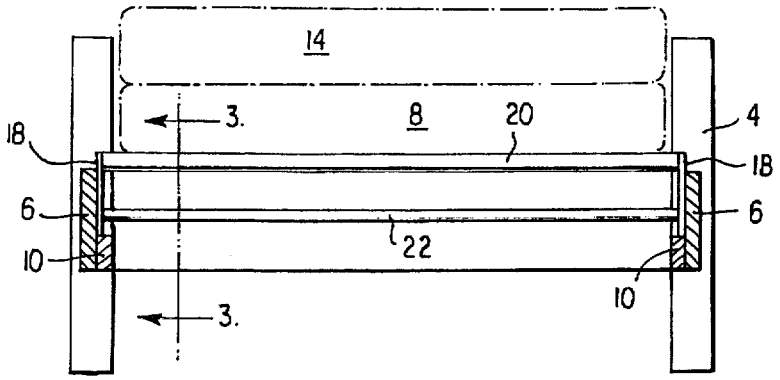
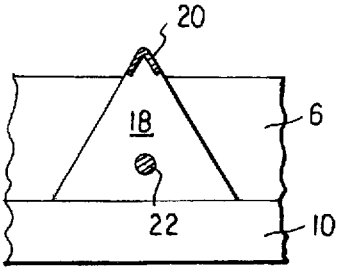
FIG. 3
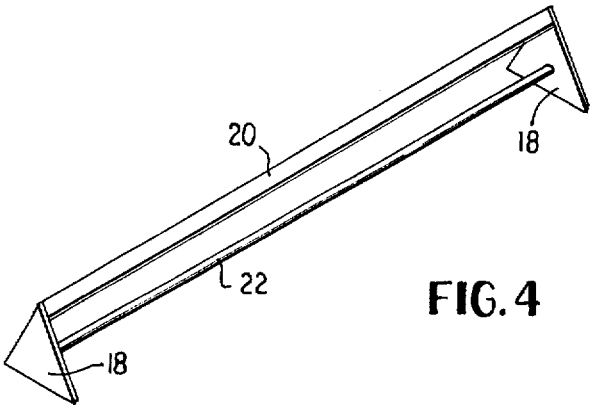
FIG. 4

APPARATUS FOR ADJUSTING THE ATTITUDE OF A MATTRESS

TECHNICAL FIELD

This invention relates to the art of beds. In particular, the invention relates to the art of devices that adjust the attitude, or angle with respect to the horizontal, of the bed.

BACKGROUND

The mattress on an ordinary bed is supported such that it is essentially horizontal. This causes a problem for many persons who require a non-horizontal position for good sleep. For example, persons suffering from breathing difficulty often require elevation of their heads. Others require elevation of their feet.

Several devices have been proposed for adjusting the angle of a mattress. For example, U.S. Pat. No. 1,599,000 (Acufi) shows a device for adjusting the angle of a mattress that includes two spaced side bars for engaging an upper part of the mattress and legs that support the upper ends of the side bars at a desired height. U.S. Patent Re. 26,411 (Alsobrook, Jr.) shows an apparatus similar to that of Acuff except that it extends along the entire length of the mattress. U.S. Pat. No. 3,952,346 (Carlson) shows a device also similar to that of Acuff that fits between the mattress and box spring. U.S. Pat. No. 5,205,005 (Merrill) shows a bed having an elevation frame. U.S. Pat. No. 5,243,726 (Bisbee) shows a device with upper and lower support frames, the upper frame receiving the mattress and being adjustable.

All of the noted devices are large and not easily transported. This means that a person cannot easily carry the mattress adjusting device when traveling for use on other mattresses.

SUMMARY OF THE INVENTION

In accordance with the invention, a device is provided that is easily manufactured and of low cost. The device is easily used and easily transported, whereby it may be used with different mattresses, as when traveling.

The device comprises base elements that are spaced to fit just between the side members of a bed frame and to be supported by the ledge normally found on such side members. The base elements are connected by a bar secured to the base elements at their tops. A second, stabilizing bar extends between the base elements to provide additional strength to the device.

In use, the box spring is lifted, and the device is placed on the frame such that each of the base elements is resting on a respective one of the spaced ledges. The box spring is then lowered so that the bottom of the box spring is resting on the bar. The angle of the mattress can then be easily adjusted by simply moving the device along the frame until the desired attitude is attained.

BRIEF DESCRIPTION OF THE DRAWINGS

FIG. 1 is a side view of a bed having a device according to the invention installed.

FIG. 2 is a cross section taken along line 2—2 of FIG. 1.

FIG. 3 is a cross section taken along line 3—3 of FIG. 2.

FIG. 4 is a perspective of a device in accordance with the invention.

DETAILED DESCRIPTION OF THE PREFERRED EMBODIMENT

With reference to FIG. 1 of the drawings, a known bed comprises a frame having a headboard 2, a footboard 4, and side rails 6. A box spring 8 is supported directly on a ledge 10 of the side rail or on slats 12 supported on the ledge. A mattress 14 is supported on the box spring.

In accordance with the invention, an apparatus 16 may be inserted beneath the box spring for adjusting the angle, or attitude, of the mattress. The apparatus comprises first and second base elements 18 spaced by the distance between the side rails and a support bar 20 extending between the base elements. A further stabilizing bar 22 extends between the base elements below the support bar.

The base elements are preferably flat and triangular in elevation. The base elements are thin, less than about one-quarter inch, to easily engage the ledge 10 and are long enough, three to six inches, to provide stability. The support bar 20 is secured to the base elements, as by welding, and the base elements may be three to six inches in height.

While the base elements are shown triangular, they may be of other shapes (e.g., rectangular) as long as the lower edge is long enough to provide adequate stability, and the tops do not interfere with the box spring. Moreover, the support bar need not necessarily be attached to the tops of the base elements. The preferred arrangement, however, reduces the possibility of interference between the tops of the base elements and the box spring while providing adequate stability.

In use, the box spring is lifted, and the apparatus 16 is placed on the ledges 10 beneath the box spring and in the desired longitudinal position. The box spring is then lowered onto the support bar, which maintains that end of the mattress higher. The location of the apparatus is selected based on the desired angle of the mattress. If the angle is to be increased or decreased, the apparatus is simply moved along the ledge in the appropriate direction until the desired angle is achieved.

The apparatus may be made of steel for sturdiness, but a variety of materials may be used as well. The apparatus will need to be supplied in widths that accommodate standard frames including twin, double, queen, and king, and may be adjustable in width. For example, the support and stabilizing bars may be adjustable by providing separate, overlapping parts for each of these two parts. The base elements are shown parallel, but they could converge slightly, if desired, provided the length of the bar 20 is sufficient to span the width of the box spring.

It will be appreciated that an easily used and transported apparatus for adjustment of the attitude of a mattress has been described. Modifications within the scope of the appended claims will be apparent to those of skill in the art.

I claim:

1. In combination, mattress means for supporting a resting person, a bed frame supporting said mattress means, and a device for adjusting an angular relationship between said mattress means and said frame, wherein said bed frame includes a ledge for supporting said mattress means and said device comprises first and second spaced frame-engaging elements engaging respective said ledges and being adapted to freely move there along, and a narrow bar extending between said frame-engaging elements and engaging a bottom surface of said mattress means at a single narrow location extending across said bottom surface, whereby said angular relationship may be adjusted by moving said device along said ledge.

2. The combination according to claim 1 wherein said frame-engaging elements are planar and said bar is secured to each said frame-engaging element at a top of each said frame-engaging element.

3. A combination according to claim 1 wherein said mattress means comprises a box spring and a mattress, said box spring being beneath said mattress.

4. A method for adjusting the angular relationship between a mattress means and a frame supporting said mattress means comprising providing a mattress means for supporting a resting person, providing a mattress frame for supporting said mattress means, providing a device for adjusting said angular relationship, placing said device on said mattress frame beneath said mattress means for supporting said mattress means, and adjusting said angular relationship by moving said device along the length of said mattress frame, wherein said device comprises first and second spaced frame-engaging elements for engaging respective opposed ledges on said mattress frame, each of said frame-engaging elements comprising an element having a bottom edge for engaging said ledge and for being freely movable there along, and a bar extending between said frame-engaging elements for engaging a bottom of said mattress means, said bar being secured to each of said frame-engaging means at a top part of each of said frame-engaging means.

* * * * *